US010144047B2

(12) United States Patent
Park

(10) Patent No.: US 10,144,047 B2
(45) Date of Patent: Dec. 4, 2018

(54) SWIVEL JIG TOOL FOR FORMING BURRING HOLE IN DOOR INNER PANEL OF VEHICLE AND METHOD OF OPERATING THE SAME

(71) Applicant: HYUNDAI MOTOR COMPANY, Seoul (KR)

(72) Inventor: Seok-June Park, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/239,058

(22) Filed: Aug. 17, 2016

(65) Prior Publication Data

US 2017/0120318 A1 May 4, 2017

(30) Foreign Application Priority Data

Nov. 4, 2015 (KR) ..... 10-2015-0154500

(51) Int. Cl.

| | |
|---|---|
| ***B21D 28/26*** | (2006.01) |
| ***B21D 19/08*** | (2006.01) |
| ***B21D 53/88*** | (2006.01) |
| ***B21D 22/04*** | (2006.01) |
| ***B21D 28/32*** | (2006.01) |

(52) U.S. Cl.

CPC ..... *B21D 28/26* (2013.01); *B21D 19/08* (2013.01); *B21D 22/04* (2013.01); *B21D 28/32* (2013.01); *B21D 53/88* (2013.01)

(58) Field of Classification Search

CPC ..... B21D 19/08; B21D 19/086; B21D 28/26; B21D 28/32; B21D 28/325

See application file for complete search history.

(56) References Cited

U.S. PATENT DOCUMENTS 7,363,794 B2 * 4/2008 Kinoshita ..... B21D 7/028 384/276
7,434,443 B2 10/2008 Tokuda
(Continued)

FOREIGN PATENT DOCUMENTS

JP H06-044488 Y2 11/1994
JP 07178464 A * 7/1995 ..... B21D 19/086
(Continued)

OTHER PUBLICATIONS

Machine translation of JP 07-178464 A, Ono, pp. 1-2, translated on Jun. 17, 2017.*

*Primary Examiner* — Teresa M Ekiert
(74) *Attorney, Agent, or Firm* — McDermott Will & Emery LLP

(57) ABSTRACT

A swivel jig tool for forming a burring hole in a door inner panel includes: a jig base; a jig slide moving forward or rearward along an upper surface of the jig base; and a jig driver disposed behind the jig slide and moving downward by its own weight and applying a force to the jig slide to move the jig slide forward. The jig base comprises: an L-shaped fixed jig base movably supporting the jig slide that is in contact with an upper surface of the L-shaped fixed jig base; a connector protruding upward from the L-shaped fixed jig base at a position opposite to a vertical part of the L-shaped fixed jig base, the connector fixing a hinge shaft thereon; and a rotating jig base mounted to the connector by the hinge shaft to rotate around the hinge shaft that is disposed in a horizontal direction.

10 Claims, 7 Drawing Sheets

(56) References Cited

U.S. PATENT DOCUMENTS

| | | | | |
|---|---|---|---|---|
| 7,624,615 | B2 * | 12/2009 | Nieschulz | B21D 19/086<br>72/452.4 |
| 7,665,341 | B2 * | 2/2010 | Kinoshita | B21D 5/04<br>72/315 |

FOREIGN PATENT DOCUMENTS

| | | | |
|---|---|---|---|
| JP | 11-010253 | A | 1/1999 |
| JP | H11-090541 | A | 4/1999 |
| JP | H11-347654 | A | 12/1999 |
| JP | 2002-346635 | A | 12/2002 |
| JP | 2012-130951 | A | 7/2012 |
| JP | 2015-098045 | A | 5/2015 |
| KR | 10-1998-044867 | A | 9/1998 |

* cited by examiner

SWIVEL JIG TOOL FOR FORMING BURRING HOLE IN DOOR INNER PANEL OF VEHICLE AND METHOD OF OPERATING THE SAME

CROSS-REFERENCE TO RELATED APPLICATIONS

This application claims the benefit of priority to Korean Patent Application No. 10-2015-0154500, filed on Nov. 4, 2015, which is incorporated herein by reference in its entirety.

TECHNICAL FIELD

The present disclosure relates to a swivel jig tool for forming a burring hole in a door inner panel and a method of operating the same, and more particularly, to a swivel jig tool for forming a burring hole in a door inner panel which has an additional base support structure, and a method of operating the same.

BACKGROUND

Generally, as shown in FIG. 1, a door inner panel 1 for a vehicle has a plurality of burring holes 1*a* which are used as fixing holes to install a variety of parts such as a door trim, a window regulator, etc.

A burring hole is a through hole which has a conical depression in a perimeter thereof so that a head of a bolt, a screw, or the like inserted into the hole can be prevented from protruding outward. In other to form such a burring hole, in conventional techniques, burring hole forming apparatus and method as shown in FIG. 2 have been used.

Hereinafter, conventional burring hole forming apparatus and method will be described in brief.

First, a conical die 2 is brought into contact with a target portion of an inner surface of a door inner panel 1 which is to be machined. A vertical part of a jig base 3 including the die 2 is brought into contact with the entirety of the inner surface of the door inner panel 1. Then, the target portion of the door inner panel 1 is punched from an outer surface of the door inner panel 1 with a burring punch 6 that is mounted to a jig slide 5, which converts vertical force of a jig driver 4 into horizontal force (or a jig pad may be coupled to the jig slide and the burring punch may be mounted to the jig pad). In this way, a burring hole 1*a* is formed in the door inner panel 1.

In the conventional techniques, a double jig tool for machining a door inner panel has been mainly used as a representative example of the above-mentioned burring hole forming apparatus. As shown in FIG. 3, in a conventional double jig tool for machining a door inner panel, a jig base 3 is linearly operated when a jig driver 4 moves downward. Subsequently, when the jig driver 4 further moves downward, a jig slide 5 is operated in the direction opposite to a direction in which the jig base 3 moves. A jig pad mounted to the jig slide 5 (and a burring punch mounted to the jig pad) moves toward the door inner panel 1. Then, the jig pad (and the burring punch mounted to the jig pad) comes into contact with the door inner panel 1 and machines it, thus forming a burring hole. However, in the case of the conventional double jig tool having the above-mentioned configuration, as shown in FIG. 4, any structure cannot be installed on a rear surface of the vertical part of the jig base 3, and therefore, durability of the jig base 3 is low. Thereby, the jig base 3 may be frequently damaged during repetitive burring hole forming operations.

Furthermore, the conventional technique is problematic in that because the size of the jig base 3 is comparatively large, space required to install the jig base 3 is also large.

Moreover, in the conventional technique, a large number of parts are required to embody the linear movement of the jig base 3.

SUMMARY

An aspect of the present disclosure is directed to a swivel jig tool for forming a burring hole in a door inner panel which has a structure capable of reducing the size of a jig base and supporting the jig base, and a method of operating the swivel jig tool.

Other objects and advantages of the present disclosure can be understood by the following description, and become apparent with reference to the embodiments in the present disclosure. Further, it is obvious to those skilled in the art to which the present disclosure pertains that the objects and advantages of the present disclosure can be realized by the means as claimed and combinations thereof.

In accordance with an embodiment in the present disclosure, a swivel jig tool for forming a burring hole in a door inner panel includes a jig base; a jig slide moving forward or rearward along an upper surface of the jig base; and a jig driver disposed behind the jig slide and moving downward by its own weight and apply a force to the jig slide so that the jig slide moves forward. The jig base includes: an L-shaped fixed jig base movably supporting the jig slide that is brought into contact with an upper surface of the L-shaped fixed jig base; a connector protruding upward from the fixed jig base at a position opposite to a vertical part of the L-shaped fixed jig base, the connector fixing a hinge shaft thereon; and a rotating jig base mounted to the connector by the hinge shaft to rotate around the hinge shaft that is disposed in a horizontal direction.

The jig base may include: a load prevention member which is interposed between the connector and the hinge shaft and prevents a load from being applied to the hinge shaft when forming the burring hole.

The swivel jig tool may further include: a backup unit coming into contact with a front surface of the rotating jig base and supporting the rotating jig base when forming the burring hole.

The backup unit may include: a support having a rear surface allowed to come into contact with the front surface of the rotating jig base.

The backup unit may include: a cylinder unit moving the support upward so that the rear surface of the support comes into contact with the front surface of the rotating jig base, or moving the support downward so that the rear surface of the support is removed from the front surface of the rotating jig base.

Inclined surfaces may be respectively formed on an upper end of the rear surface of the support and a lower end of the front surface of the rotating jig base.

When the cylinder unit moves downward, the inclined surface of the support and the inclined surface of the rotating jig base may come into contact with each other.

The backup unit may include: a cylinder-unit damage indicator informing, when the cylinder unit is damaged, the damage of the cylinder unit to a user.

The jig slide may include a jig slide body moving along the upper surface of the jig base by the weight of the jig driver.

The jig slide may include: a jig pad mounted to a front side of the jig slide body; and a burring punch mounted to a front portion of the jig pad to form the burring hole in the door inner panel as the jig pad moves forward.

The jig slide may include a gas spring installed in a lower end of the jig slide body and rotating the rotating jig base in a direction opposite to a direction of gravity when moving forward.

In the swivel jig tool, the center of gravity of the rotating jig base is disposed ahead of the hinge shaft so that the rotating jig base rotates in a direction of gravity when no external force is applied to the jig base.

In accordance with another embodiment in the present disclosure, a method of operating a swivel jig tool for forming a burring hole in a door inner panel includes: moving a jig driver downward by a force of gravity and moving a jig slide body forward by the jig driver; operating a gas spring to move forward and rotating a rotating jig base in a direction opposite to a direction of gravity; operating a cylinder unit and moving a support upward so that a front surface of the rotating jig base is supported by the support; and moving a jig pad which has a burring punch forward to form the burring hole in the door inner panel that is supported by the rotating jig base.

DESCRIPTION OF SPECIFIC EMBODIMENTS

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. Specific structural and functional descriptions of embodiments in the present disclosure disclosed herein are only for illustrative purposes of the exemplary embodiments, and the present description is not intended to represent all of the technical spirit of the present disclosure. On the contrary, the present disclosure is intended to cover not only the exemplary embodiments, but also various alternatives, modifications, equivalents, and other embodiments that may be included within the spirit and scope of the present disclosure as defined by the appended claims. In the description, details of well-known features and techniques may be omitted to avoid unnecessarily obscuring the gist of the present disclosure. Hereinafter, exemplary embodiments will be described in detail with reference to the attached drawings.

Figure 5:
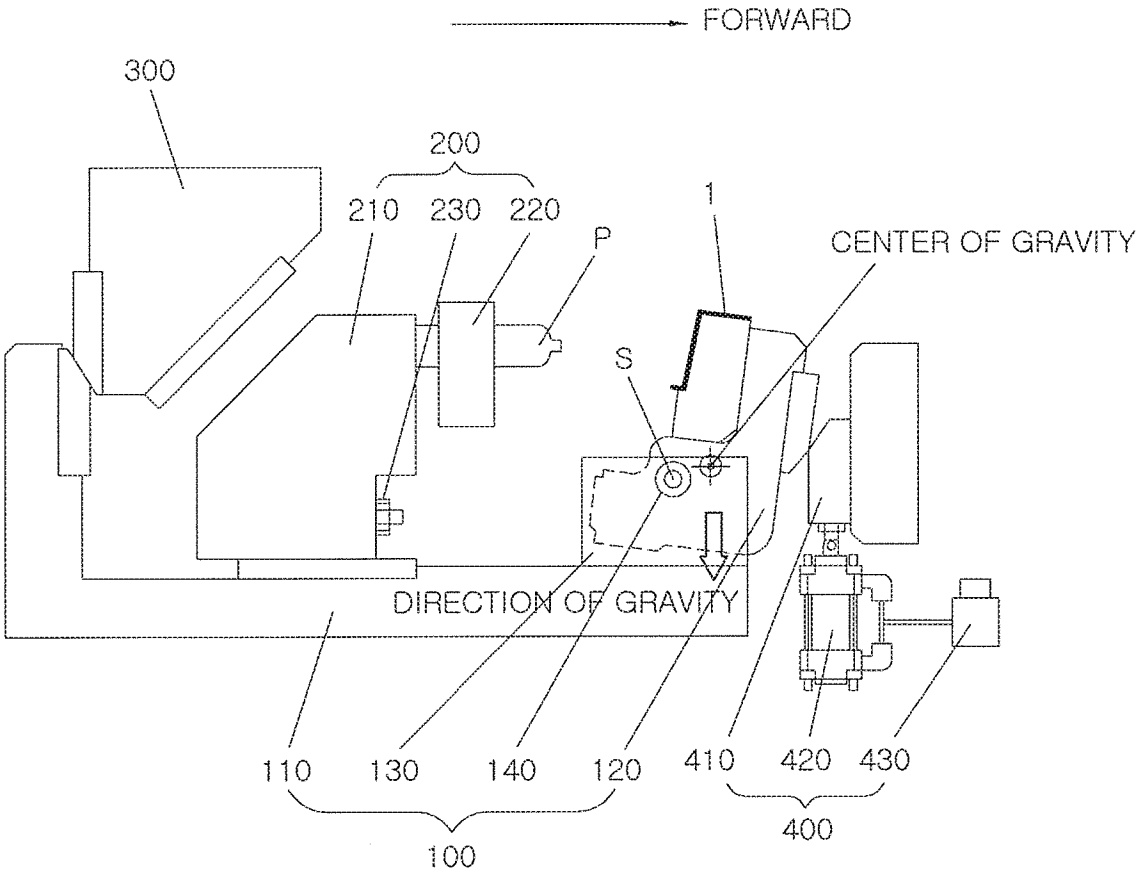
FIG. 5 is a sectional view illustrating a swivel jig tool for forming a burring hole in a door inner panel according to an embodiment in the present disclosure.

FIG. 5 is a sectional view illustrating a swivel jig tool for forming a burring hole in a door inner panel according to an embodiment in the present disclosure. Referring to FIG. 5, a swivel jig tool includes a jig base 100, a jig slide 200, a jig driver 300, and a backup unit 400.

The jig base 100 includes a fixed jig base 110, a rotating jig base 120, and a connector 130. The fixed jig base 110 movably supports the jig slide 200 coming into contact with an upper surface thereof. The fixed jig base 110 may have an L shape. The connector 130 protrudes upward from the fixed jig base 110 at a position opposite to a vertical portion of the fixed jig base 110 and supports a hinge shaft S. The rotating jig base 120 is mounted to the connector 130 by the hinge shaft S so as to rotate around the hinge shaft S that is disposed in a horizontal direction.

Figure 1:
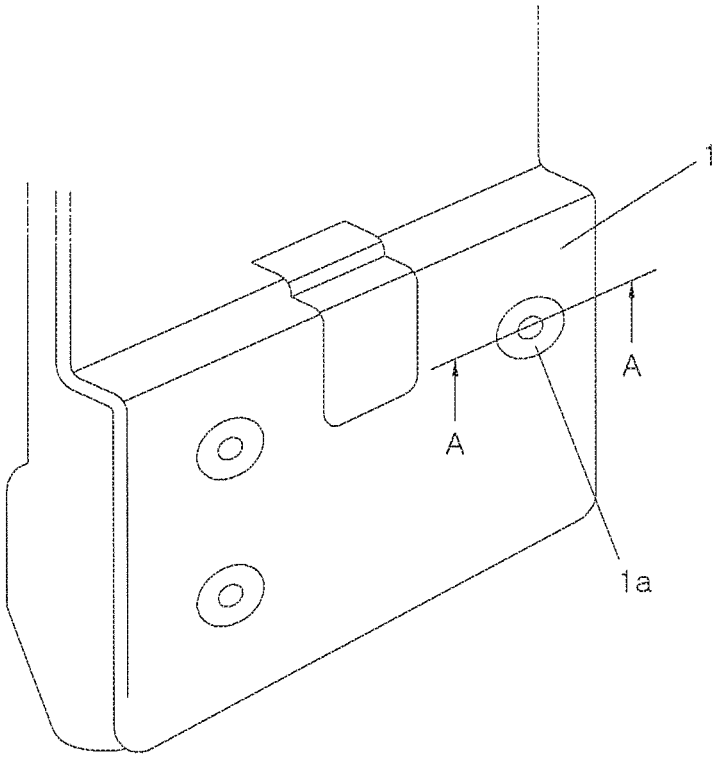
FIG.1 (Prior Art)
FIG. 1 is a view illustrating a burring hole formed in a door inner panel.
Figure 2:
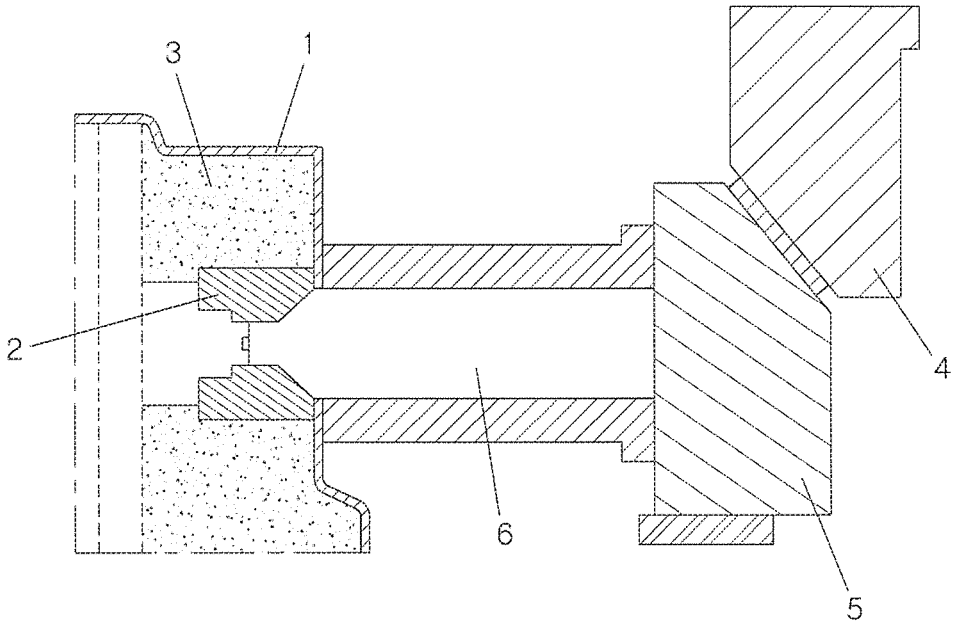
FIG.2(Prior Art)
FIG. 2 is a view illustrating apparatus and method for forming a burring hole according to the conventional technique.
Figure 3:
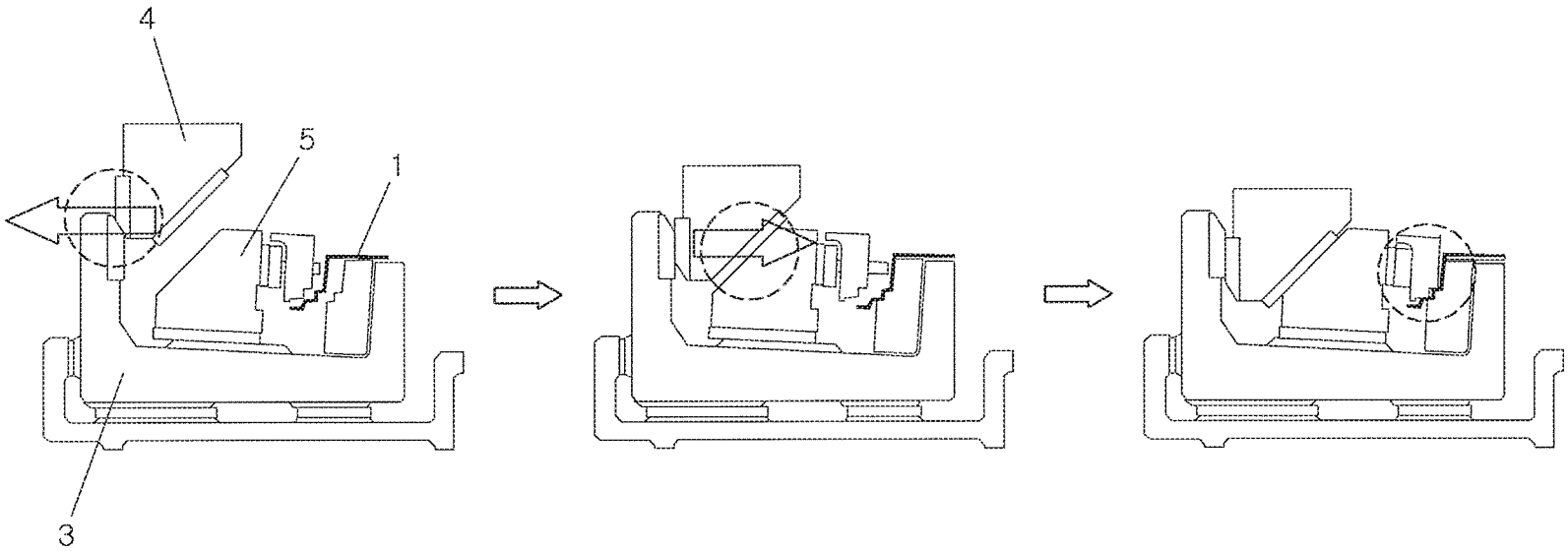
FIG.3(Prior Art)
FIG. 3 is a view illustrating the operation of a double jig tool for machining a door inner panel according to the conventional technique.
Figure 4:
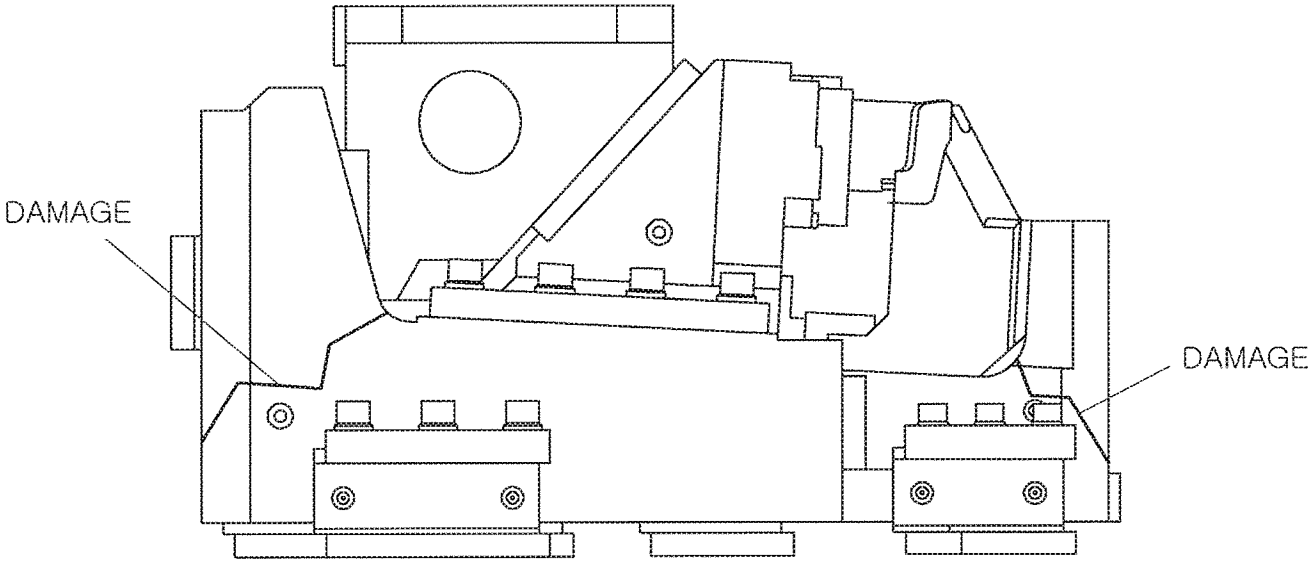
FIG.4(Prior Art)
FIG. 4 is a view illustrating problems of the double jig tool according to the conventional technique.

The jig base 3 of the conventional double jig tool for machining a door inner panel has a single body with a U shape (refer to FIGS. 3 and 4). However, the jig base 100 according to the present disclosure is divided into the fixed jig base 110 and the rotating jig base 120. Unlike the jig base 3 of the conventional double jig tool which slides forward or rearward, in the present disclosure, there is no need to move the jig base 100. Therefore, a space required to install the backup unit 400 can be provided, whereby the jig base 100 can be prevented from being damaged.

A load prevention member 140 may be interposed between the connector 130 and the hinge shaft S so as to prevent a load from being applied to the hinge shaft S during a burring hole forming process. Furthermore, the center of gravity of the rotating jig base 120 may be disposed ahead of the hinge shaft S so that the rotating jig base 120 can rotate in the direction of gravity when no external force is applied thereto.

The jig slide 200 may move forward or rearward along the jig base 100, in particular, an upper surface of the fixed jig base 110. The jig slide 200 includes a jig slide body 210, a jig pad 220, and a gas spring 230.

The jig slide body 210 can move forward along the upper surface of the jig base 100 by the weight of the jig driver 300. The jig pad 220 is mounted to a front side of the jig slide body 210. A burring punch P is mounted to a front portion of the jig pad 220 so that when the jig pad 220 moves forward, the burring punch P machines a door inner panel 1. The gas spring 230 is installed in a lower end of the jig slide body 210. The gas spring 230 functions to rotate, when moving forward, the rotating jig base 120 in a direction opposite to the direction of gravity. That is, unlike the jig slide of the conventional double jig tool for machining a door inner panel, the jig slide 200 according to the present disclosure includes the gas spring 230 in which the gas spring 230 rotates the rotating jig base 120. Thereby, the space required to install the backup unit 400 can be provided, whereby the jig base 100 can be prevented from being damaged.

The jig driver 300 is disposed behind the jig slide 200, moves downward by its own weight, and applies force to the jig slide 200, thus moving the jig slide 200 forward.

The backup unit 400 comes into contact with a rear surface of the rotating jig base 120 and also supports the rotating jig base 120 during the burring operation. The backup unit 400 includes a support 410, a cylinder unit 420, and a cylinder-unit damage indicator 430. The support 410 has a rear surface which can come into contact with the front surface of the rotating jig base 120. The cylinder unit 420 can move the support 410 upward so that the rear surface of the support 410 comes into contact with the front surface of the rotating jig base 120 or move the support 410 downward so that the rear surface of the support 410 is removed from the front surface of the rotating jig base 120. When the cylinder unit 420 is damaged, the cylinder-unit damage indicator 430 informs a worker of the damage of the cylinder unit 420.

Figure 6:
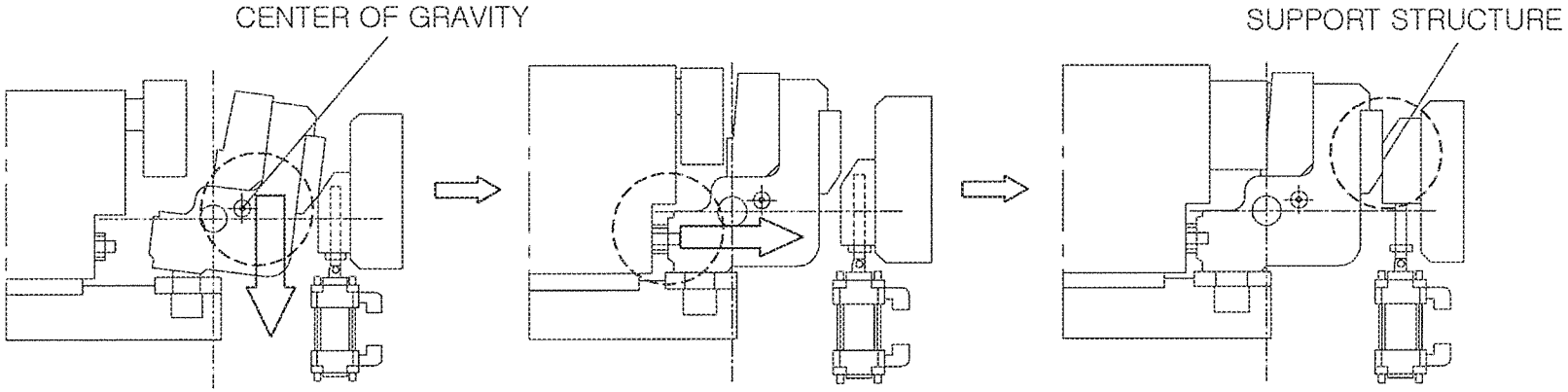
FIG. 6 illustrates an operation of the swivel jig tool according to an embodiment in the present disclosure.

FIG. 6 illustrates an operation of the swivel jig tool for forming the burring hole in the door inner panel according to an embodiment in the present disclosure. Referring to FIG. 6, in the swivel jig tool according to the present disclosure, the rotating jig base 120 rotates in the direction of gravity by the weight of the rotating jig base 120 at an initial stage (that is, in an operation standby state). Here, the cylinder unit 420 is in a downward moved state, and an inclined surface of the support 410 and an inclined surface of the rotating jig base 120 are brought into contact with each other. Thus, the rotating jig base 120 rotated by a preset angle in the direction of gravity can be in a standby state without rotating further (refer to the left view of FIG. 6).

To start the burring operation, the jig driver 300 moves downward by its own weight, whereby the jig slider 200 moves forward. Thereafter, the gas spring 230 pushes a lower end of the rotating jig base 120 forward. Then, the rotating jig base 120 rotates in the direction opposite to the direction of gravity. That is, the swivel jig tool enters an operation ready state (refer to the intermediate view of FIG. 6).

Subsequently, the cylinder unit 420 moves upward so that the rear surface of the support 410 and the front surface of the rotating jig base 120 come into contact with each other. That is, the support 410 backs up the rotating jig base 120. After the cylinder unit 420 moves upward, the jig pad 220 and the burring punch P move forward. Thereby, the door inner panel 1 is machined (refer to the right view of FIG. 6).

As described above, in the present disclosure, since the backup unit 400 can support the rotating jig base 120 during the burring operation, the jig base 100 can be enhanced in durability and thus prevented from being damaged. As a result of a load measuring test for verifying this, in the conventional jig base 3, a load applied to the front portion of the jig base 3 during the burring operation was 27.8 Mpa, and a load applied to the rear portion of the jig base 3 was 31.7 Mpa (refer to FIG. 4). However, in the rotating jig base 120 according to the present disclosure, a load applied to the rotating jig base 120 during the burring operation was 7.9 Mpa. That is, it could be determined that the present disclosure can reduce the load by about 71% compared to that of the conventional technique.

Furthermore, in the present disclosure, because there is no need for the jig base 100 to slide, the size of the jig base 100 can be reduced. In detail, as a result of measurement, it was determined that compared to the conventional double jig tool (0.23 $m^3$=0.535×0.43×1) for machining a door inner panel, the swivel jig tool (0.088 $m^3$=0.515×0.22×0.78) according to the present disclosure can reduce space required for installation by about 61%. Moreover, in the present disclosure, parts required to slide the jig base 3 in the conventional technique can be removed. Therefore, it will be understood that there is also effect of reducing production cost.

Figure 7:
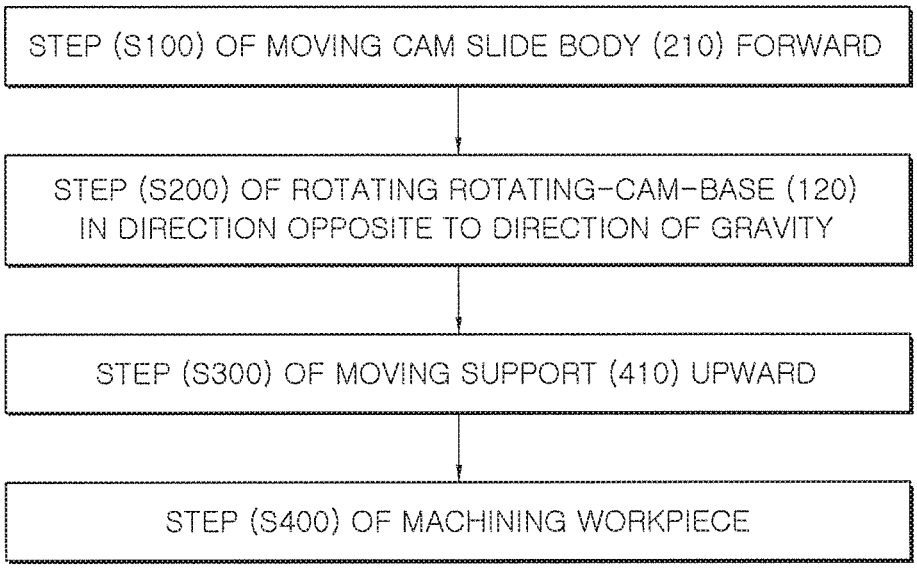
FIG. 7 is a flowchart showing a method of operating a swivel jig tool for forming a burring hole in a door inner panel according to another embodiment in the present disclosure.

FIG. 7 is a flowchart showing a method of operating a swivel jig tool for forming a burring hole in a door inner panel according to another embodiment in the present disclosure. Referring to FIG. 7, the method of operating the swivel jig tool for forming a burring hole in a door inner panel according to the present disclosure includes: a step S100 of moving the jig driver 300 downward by the force of gravity and moving the jig slide body 210 forward by the jig driver 300; a step S200 of operating the gas spring 230 to move forward and rotating the rotating jig base 120 in the direction opposite to the direction of gravity; a step S300 of operating the cylinder unit 420 and moving the support 410 so that the front surface of the rotating jig base 120 is supported by the support 410; and a step S400 of moving the jig pad 220 provided with the burring punch P forward and machining a door inner panel 1 supported by the rotating jig base 120.

As described above, in accordance with the present disclosure, there is no need for a jig base to slide. Therefore, the size of the jig base can be reduced, and parts required to slide the jig base can be removed.

Furthermore, in the present disclosure, a jig base support structure is added, thus increasing the durability of the jig base and preventing the jig base from being damaged.

Although the specific embodiments have been disclosed, they are only examples of the present disclosure to allow one having ordinary skill in the art to easily implement the present disclosure. Therefore, the bounds of the present disclosure are not limited to the embodiments. The skilled person will appreciate that various modifications and changes are possible without departing from the technical spirit of the invention, and those modifications and changes belong to the scope accompanying claims.

What is claimed is:

1. A swivel jig tool for forming a burring hole in a door inner panel, the swivel jig tool comprising:

a jig base;

a jig slide moving forward or rearward along an upper surface of the jig base; and a jig driver disposed behind the jig slide and moving downward by its own weight and applying a force to the jig slide to move the jig slide forward, wherein the jig base comprises:

an L-shaped fixed jig base movably supporting the jig slide that is in contact with an upper surface of the L-shaped fixed jig base;

a connector protruding upward from the L-shaped fixed jig base at a position opposite to a vertical part of the L-shaped fixed jig base, the connector fixing a hinge shaft thereon; and a rotating jig base mounted to the connector by the hinge shaft to rotate around the hinge shaft that is disposed in a horizontal direction, wherein the jig slide comprises:

a jig slide body moving along the upper surface of the jig base by the weight of the jig driver;

a jig pad mounted to a front side of the jig slide body;

a burring punch mounted to a front portion of the jig pad to form the burring hole in the door inner panel as the jig pad moves forward; and a gas spring installed in a lower end of the jig slide body and rotating the rotating jig base.

2. The swivel jig tool of claim 1, further comprising:

a backup unit coming into contact with a front surface of the rotating jig base and supporting the rotating jig base when forming the burring hole.

3. The swivel jig tool according to claim 2, wherein the backup unit comprises:

a support allowing a rear surface thereof to come into contact with the front surface of the rotating jig base.

4. The swivel jig tool according to claim 3, wherein the backup unit further comprises:

a cylinder unit moving the support downward so that the rear surface of the support is removed from the front surface of the rotating jig base.

5. The swivel jig tool according to claim 3, wherein the backup unit further comprises:

a cylinder unit moving the support upward so that the rear surface of the support comes into contact with the front surface of the rotating jig base.

6. The swivel jig tool according to claim 5, wherein the backup unit comprises:

a cylinder-unit damage indicator informing, when the cylinder unit is damaged, the damage of the cylinder unit to a user.

7. The swivel jig tool according to claim 5, wherein the support and the rotating jig base have inclined surfaces respectively formed on an upper end of the rear surface of the support and a lower end of the front surface of the rotating jig base.

8. The swivel jig tool according to claim 7, wherein when the cylinder unit moves downward, the inclined surface of the support and the inclined surface of the rotating jig base come into contact with each other.

9. The swivel jig tool according to claim 1, wherein a center of gravity of the rotating jig base is disposed ahead of the hinge shaft so that the rotating jig base rotates in a direction of gravity when no external force is applied to the jig base.

10. A method of operating a swivel jig tool for forming a burring hole in a door inner panel, the method comprising:

moving a jig driver downward by a force of gravity and moving a jig slide body forward by the jig driver;

operating a gas spring to move forward and rotating a rotating jig base;

operating a cylinder unit and moving a support upward so that a front surface of the rotating jig base is supported by the support;

supporting the door inner panel on the rotating jig base; and moving a jig pad, which has a burring punch, forward to form the burring hole in the door inner panel.

* * * * *